US005791884A

United States Patent [19]

Iio et al.

[11] Patent Number: 5,791,884

[45] Date of Patent: Aug. 11, 1998

[54] SCROLL COMPRESSOR WITH SEALED TERMINAL

[75] Inventors: Takayuki Iio; Mikihiko Ishii; Shigeki Miura; Ryuhei Tanigaki, all of Nishi-Kasugai-gun, Japan

[73] Assignee: Mitsubishi Jukogyo Kabushiki Kaisha, Tokyo, Japan

[21] Appl. No.: 516,101

[22] Filed: Aug. 18, 1995

[30] Foreign Application Priority Data

Nov. 17, 1994 [JP] Japan ..... 6-308128
Jan. 17, 1995 [JP] Japan ..... 7-020882

[51] Int. Cl.[6] ..... F04L 18/04; F04B 49/00

[52] U.S. Cl. ..... 418/2; 417/63; 174/151; 174/65 R; 418/55.1; 439/544

[58] Field of Search ..... 417/63, 902, 313; 174/151, 65 R, 65 SS, 65 G, 152 GM; 310/71; 439/544, 550, 927, 935; 418/2, 55.1

[56] References Cited

U.S. PATENT DOCUMENTS

| | | | |
|---|---|---|---|
| 3,009,012 | 11/1961 | Polese | 174/151 |
| 4,104,484 | 8/1978 | Ijlstra et al. | 174/151 |
| 4,420,210 | 12/1983 | Karol et al. | 174/152 GM |
| 4,904,551 | 2/1990 | Denoncourt et al. | 174/152 GM |
| 5,118,260 | 6/1992 | Fraser, Jr. . | |
| 5,215,451 | 6/1993 | Hara et al. | 417/902 |
| 5,422,437 | 6/1995 | Schnell | 174/65 R |

FOREIGN PATENT DOCUMENTS

| | | | |
|---|---|---|---|
| 870957 | 3/1941 | France | 174/151 |
| 2547369 | 12/1984 | France . | |
| 1111256 | 7/1961 | Germany . | |
| 800991 | 9/1958 | United Kingdom | 439/935 |
| 984912 | 3/1965 | United Kingdom . | |

*Primary Examiner*—Timothy Thorpe
*Assistant Examiner*—Peter G. Korytnyk
*Attorney, Agent, or Firm*—Wenderoth, Lind & Ponack, L.L.P.

[57] ABSTRACT

A scroll compressor has a stationary scroll and a swivel scroll engaged with each other in a hermetic housing. A sealed terminal is provided to send signals outside of the housing from a sensor that is provided within the housing. The sealed terminal is inserted into a fitting hole that passes through the outer wall of the housing. A push nut having a plurality of nails is pressed into the fitting hole to hold the sealed terminal within the fitting hole. The push nut has a plurality of nails having an outer diameter slightly larger than the inner diameter of the fitting hole.

17 Claims, 3 Drawing Sheets

SCROLL COMPRESSOR WITH SEALED TERMINAL

BACKGROUND OF THE INVENTION

1. Field of the Invention

The present invention relates to a scroll type compressor suitable for air conditioners for vehicles.

2. Description of the Prior Art

One example of a conventional scroll compressor is shown in FIG. 3. In FIG. 3, a hermetic housing, designated by numeral 1, consists of a cup-like body 2, a cover 4 fixed thereto by bolts 3 and a cylindrical element 6 fixed thereto by bolts (not shown in the figure). A rotating shaft 7, passing through the cylindrical element 6, is rotatably supported by the hermetic housing 1 via bearings a and 9.

A stationary scroll 10 and a swivel scroll 14 are provided within the hermetic housing 1. The stationary scroll 10 has an end plate 11 and a spiral wrap 12 provided standing on its inner surface. The end plate 11 is fixed to the cup-like body 2 by bolts 13. Further, a discharge port 29 is provided at the central part of the end plate 11, and opening and closing of the discharge port 29 is performed by a discharge valve 30.

The swivel scroll 14 has an end plate 15 and a spiral wrap 16 provided standing on its inner surface. The spiral wrap 16 is of substantially the same shape as the spiral wrap 12 of the stationary scroll 10.

The swivel scroll 14 and the stationary scroll 10 are engaged with each other eccentrically by a length of a radius of the revolution and with a deviation of angle of 180 degrees, as shown in the figure. Thus, a tip seal 17 embedded on the tip surface of the spiral wrap 12 Wealingly contacts the inner surface of the end plate 15. A tip seal 18 embedded on the tip surface of the spiral wrap 16 sealingly contacts the inner surface of the end plate 11. The side surfaces of spiral wraps 12 and 16 make line contacts with each other at a plurality of places, thereby forming a plurality of compression chambers 19*a* and 19*b* nearly in point symmetry with each other around the centers of the spirals.

Within a cylindrical boss 20 projecting at the central part of the outer surface of the end plate 15 is inserted a drive bush 21. The bush 21 is rotatable via a revolutional bearing 23. Within a slide groove 24 in the drive bush 21 is slidably inserted an eccentric drive pin 25 that eccentrically projects from an inner end of the rotating shaft 7. The drive bush 21 is fitted with a balance weight for balancing dynamic imbalances caused by revolutional swivel motions of the swivel scroll.

The outer circumferential surface of the end plate 11 and the inner circumferential surface of the cup-like body 2 sealingly contact each other. The inner space of the hermetic housing 1 is thereby partitioned into a high pressure chamber 31 formed on the outer side of the end plate 11 and a low pressure chamber 28 defined on the inner side of the end plate 11. On the other hand, a suction chamber 32 and a discharge chamber 33 are formed within the cover 4. The discharge chamber 33 is connected to the high pressure chamber 31 by a path (not shown in the figure) and the suction chamber 32 is directly connected to the low pressure chamber 28.

Incidentally, numeral 36 designates a thrust bearing provided between the circumferential edge of the outer surface of the end plate 15 and the inner end surface of the cylindrical element 6. Numeral 26 designates a rotation preventing mechanism consisting of an Oldham coupling for allowing revolutional swivel motions of the swivel scroll 74 but preventing rotation thereof, and numeral 35 designates a balance weight fixed to the rotating shaft 7.

Thus, upon an electromagnetic clutch 37 being turned on, power from a running engine (not shown in the figure) is transmitted to the rotating shaft 7 via a belt 38 and the electromagnetic clutch 37. With rotation of the rotating shaft 7, the swivel scroll 14 is driven via the eccentric drive pin 25, the drive bush 21 and the boss 20. The swivel scroll 14, being prevented from rotating by the rotation preventing mechanism 26, goes through revolutional swivel motions on a circular track having a radius of revolution of the amount of eccentricity between the rotating shaft and the eccentric drive pin 25.NOV.

The line contact parts of the side surfaces of the spiral wraps 12 and 16 move gradually in the direction of the spiral centers. As a result, the compression chambers 19*a* and 19*b* move, with the volume thereof being reduced, in the direction of the spiral centers.

Gas flowing into the low pressure chamber 28 from a suction inlet (not shown in the figure) via the suction chamber 32 is taken into each of the compression chambers 19*a* and 19*b* from openings of the outer ends of the spiral wraps 12 and 16. While being compressed, the gas moves into the central chamber 22 and passes through the discharge port 29, pushing open the discharge valve 30. It is then discharged into the high pressure chamber 31 and flows out through a discharge outlet (not shown in the figure) via the discharge chamber 33.

While the swivel scroll 14 goes through revolutional swivel motions, it receives a centrifugal force acting in the direction of eccentricity. A gas force due to the compressed gas exists in each of the compression chambers 19*a* and 19*b*. By a composition of forces, the swivel scroll 14 is pushed in a direction to increase the revolutional radius, and thereby the side surfaces of the spiral wrap 16 sealingly contact the side surfaces of the spiral wrap 12 of the stationary scroll 10, preventing leakage of the gas from the compression chambers 19*a* and 19*b*.

Further, while the side surfaces of the spiral wrap 12 and the side surfaces of the spiral wrap 16 make sliding motions while maintaining a sealing contact, the revolutional radius of the swivel scroll 14 automatically changes. At the same time the eccentric drive pin 25 glides in the slide groove 24 along its longitudinal direction.

Within the discharge chamber 33, a thermosensor 50 is provided so that the thermosensor 50 senses temperatures of the discharge gas and turns off the electromagnetic clutch to stop the compressor when the temperature of the discharge gas rises to a certain specified temperature. The thermosensor 50 is connected to outer wiring 52 via a sealed terminal 51 fitted to the cover 4.

The sealed terminal 51 is inserted into a fitting hole 53, a through hole in the cover 4, from its inner opening so that the front surface of the sealed terminal 51 touches a shoulder part 59 formed on the inner surface of the fitting hole 53. A snap ring 54 is put in a groove 55 provided on the inner circumferential surface of the fitting hole 53 so as to be positioned on the rear surface of the sealed terminal 51. The sealed terminal 51 is thereby fitted to the cover 4. Incidentally, numeral 56 designates an O-ring for preventing the high pressure gas in the discharge chamber 33 from leaking through an interstice between the fitting hole 53 and the sealed terminal 51.

In the conventional scroll compressor, a snap ring 54 is used for fitting the sealed terminal 51 within the fitting hole 53. The groove 55 in which the snap ring 54 is put is very small (e.g. the groove 55 is 1.1 mm wide and 0.5 mm deep when the inner diameter of the fitting hole 53 is 18 mm), and for this reason a finishing work of the groove 55 to take off residual flashes must be done by hand, which is expensive. Further, if some flashes remain, there is a fear that the O-ring 56 might be harmed by the remaining flashes when the sealed terminal 57 is inserted into the fitting hole 53, and the high pressure gas in the discharge chamber 33 leak outside.

SUMMARY OF THE INVENTION

It is therefore an object of the present invention to resolve the above-mentioned shortcomings in the prior art. One feature of the present invention is a scroll compressor in which a stationary scroll and a swivel scroll engaged with each other are provided in a hermetic housing, the swivel scroll making revolutional swivel motions, and a sealed terminal to send a signal outside from a sensor provided within the hermetic housing is inserted into a fitting hole passing through an outer wall of the hermetic housing. A push nut has a plurality of nails at an outer circumferential portion thereof. The nails are slightly inclined, and the outer diameter of the nails is slightly larger than the inner diameter of the fitting hole The push nut is pressed into the fitting hole, and thereby the sealed terminal is fitted within the fitting hole.

Another feature of the present invention is that the plurality of nails are provided with equal intervals on the outer circumferential part.

Another feature of the present invention is that the push nut has a hole at the center which is large enough for a cover tube and a signal wire to pass through for sending a signal outside of the sealed terminal.

Another feature of the present invention is that the sealed terminal and the push nut are pre-assembled as a unit and they are inserted into the fitting hole.

Another feature of the present invention is that the push nut is lapped on the rear surface of the sealed terminal and preassembled as a unit by spot welding, etc.

Another feature of the present invention is that the sealed terminal is divided into two parts, a front part and a rear part. The push nut is placed between the so-divided sealed terminals to form a pre-assembled unit.

According to the present invention, a sealed terminal is inserted within a fitting hole and a push nut is pressed within the fitting hole. Nails on the outer circumferential part of the push nut bite into the inner circumferential surface.

Further according to the present invention, a cover tube and a signal wire can be easily placed so as to pass through a central hole of the push nut.

Further according to the present invention, the sealed terminal and a push nut, if pre-assembled as a unit, can be easily fitted within a fitting hole by being inserted together into the fitting hole.

BRIEF DESCRIPTION OF THE DRAWINGS

In the accompanying drawings:

FIG. 1 shows a first preferred embodiment of the present invention, wherein

FIG. 2 shows a push nut, wherein

DESCRIPTION OF THE PREFERRED EMBODIMENTS

Figure 1A:
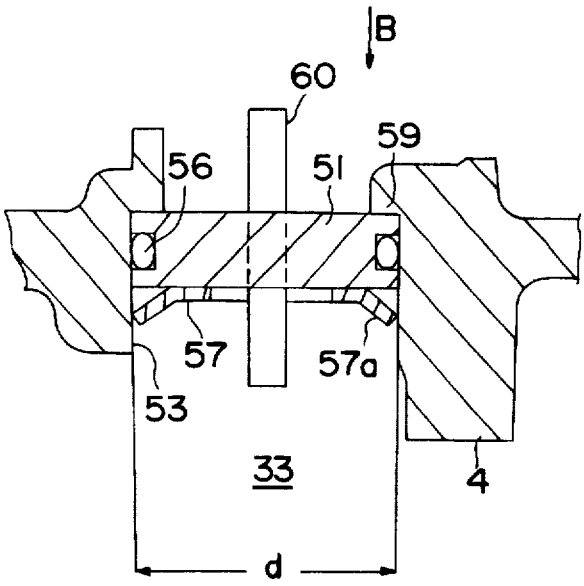
FIG. 1(A) is a cross section of a main part of the present invention and FIG. 1(B) is a view seen from a direction of an arrow of FIG. 1(A).
Figure 1B:
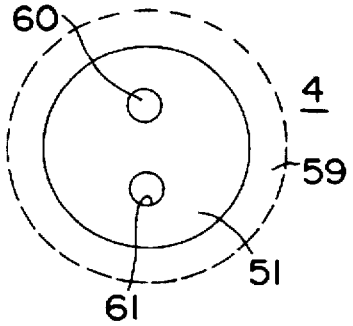

A first preferred embodiment of the present invention is shown in FIG. 1. AS shown in FIG. 1, a sealed terminal 51 is inserted into a fitting hole 53, passing through a cover 4, from its inner opening so that a front surface of the sealed terminal touches a shoulder part 59 of the fitting hole 53. A push nut 57 is then pressingly inserted into the fitting hole 53 so that a front surface of the push nut contacts and presses a rear surface of the sealed terminal 51, and thus the sealed terminal 51 is fitted to a hermetic housing 1.

Incidentally, numeral 60 designates a cover tube passing a signal wire connected to a thermosensor 50. The cover tube 60 passes in a sealed manner through a through hole 61 in the sealed terminal 51.

Figure 2A:
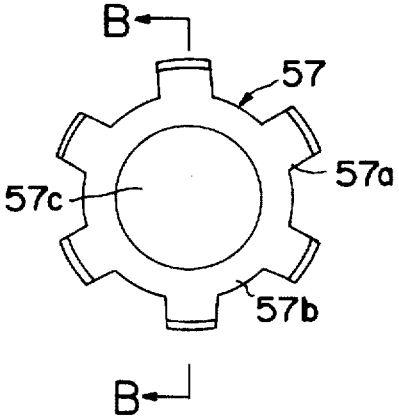
FIG. 2(A) is a front view thereof and FIG. 2(B) is a cross section taken on line B—B of FIG. 2(A).
Figure 2B:
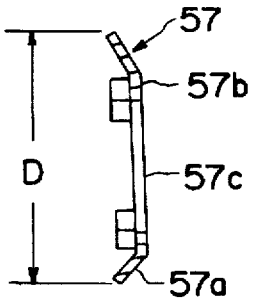

A push nut, as shown in FIG. 2, is made by press forming a thin plate (erg. 0.4 mm thickness) of a heat treated spring steel. A circular hole **57*c* is at the center of an annular body 57*b*. A plurality (six in the figure) of nails 57*a* are slightly inclined in a backward direction and are formed on the outer circumferential part of the body 57*b*. The outer diameter D of the nails 57*b* is made slightly larger (e.g. by 0.2 mm) than the inner diameter d of the fitting hole 53**.

Figure 3:
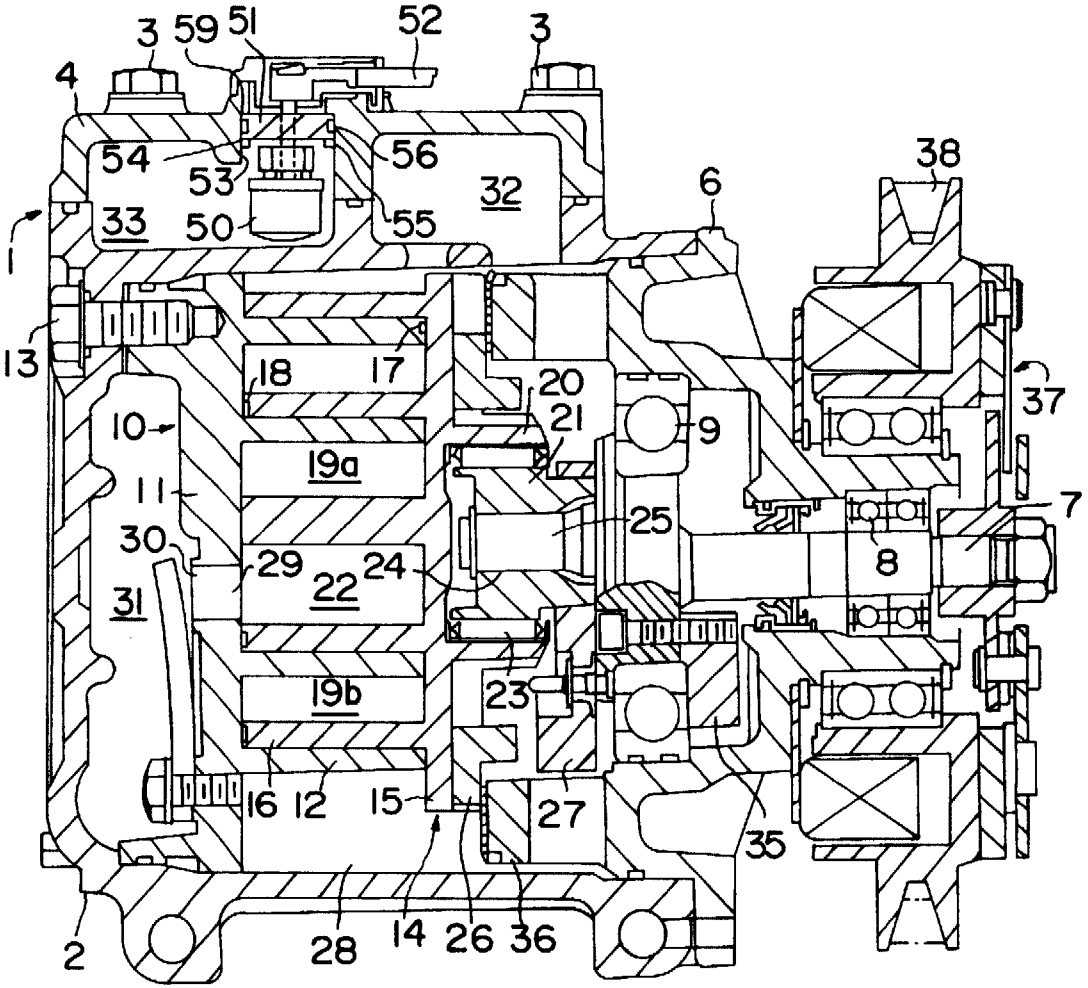
FIG.3 PRIOR ART
FIG. 3 is a longitudinal cross section of a scroll compressor of the prior art fig.

Other constructions and functions are the same as those of the prior art shown in FIG. 3, and thus corresponding elements are designated by the same numerals.

Thus, the sealed terminal 51 is inserted in the fitting hole 53, and the push nut 57 is pressed and inserted. Nails **57*a* bite into the inner surface of the fitting hole 53, and thus the sealed terminal 51 is fitted easily and quickly within the fitting hole 53**.

Once the sealed terminal 51 is fitted, even if a force acts on the sealed terminal 51 in the direction opposite to the direction of insertion (acting e.g. when an outer wiring 52 is being connected), the outer diameter D of the nails **57*a* wants to enlarge, and thus the tips of the nails 57*a* further encroach upon the inner surface of the fitting hole 53. Hence there is no chance of the sealed terminal 51 getting out of the fitting hole 53**.

Figure 4:
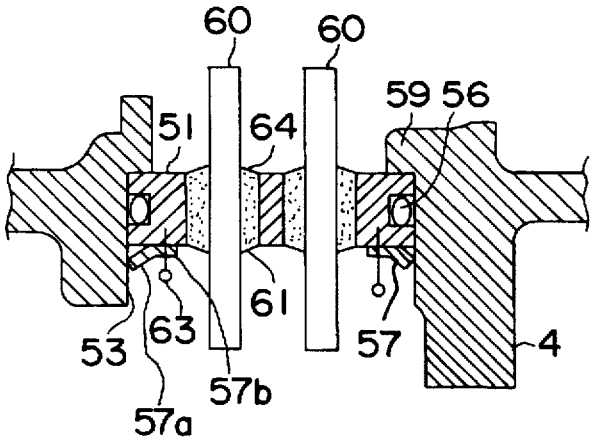
FIG.4 is a cross section of a main part showing a second preferred embodiment of the present invention.

A second preferred embodiment of the present invention is shown in FIG. 4. In this second preferred embodiment of the present invention, a push nut 57 is lapped over an outer surface of a sealed terminal 51 so that the nails **57*a* face in the outward direction. A body 57*b* of the push nut 57 is applied to the terminal 51 by spot welding at a plurality of places at intervals along the circumferential direction. Thus the sealed terminal 51 and the push nut 57 are pre-assembled as a unit. Interstices between a cover tube 60 and a through hole 61 are filled with, and sealed by, molten glass 64 and thereby the cover tube 60 is fixed in the sealed terminal 51**.

Thus, a pre-assembled unit of the sealed terminal 51 and the push nut 57 is inserted in a fitting hole 53 so that a front surface of the sealed terminal 51 touches a shoulder part 59. Then nails **57*a* of the push nut 57 bite upon the inner surface of the fitting hole 53, and the sealed terminal 51 and the push nut 57 are fitted within the fitting hole 53** with one action.

Other constructions and functions are the same as those of the first preferred embodiment shown in FIG. 1 and FIG. 2, and thus corresponding elements are designated with the same numerals.

Figure 5:
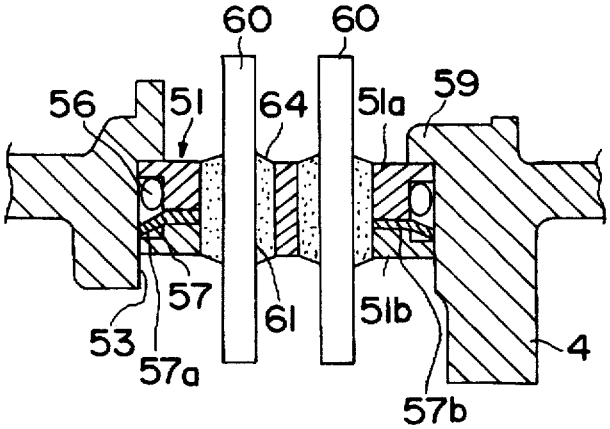
FIG. 5 is a cross section of a main part showing a third preferred embodiment of the present invention.

A third preferred embodiment of the present invention is shown in FIG. 5. In this third preferred embodiment of the present invention, a sealed terminal 51 is divided into two parts, a front part 51A and a rear part 51B. Between so-divided elements 51A and 51B, a body **57*b* of a push nut 57 is placed so that nails 57*a* thereof face in the outward direction. Interstices between a cover tube 60 and a through hole 61 are filled with molten glass, and thereby elements 51A and 51B and the push nut 57 are pre-assembled as a unit. Thus, a preassembled unit of the sealed terminal 51 and the push nut is inserted in a fitting hole 53, and these elements can be fitted within a fitting hole 53** with one action.

Other constructions and functions are the same as those of the first preferred embodiment shown in FIG. 1 and FIG. 2, and thus corresponding elements are designated with the same numerals.

According to the present invention a sealed terminal is inserted in a fitting hole and a push nut is pressingly inserted in the fitting hole. The sealed terminal can thereby be fitted within the fitting hole.

As a result, the work of making a groove to receive a snap ring and the work of taking off residual flashes, as heretofore necessitated, are not required. The necessary man-hours can thus be reduced. Further, damage to an O-ring due to residual flashes of the groove no longer occurs, so that gas in the hermetic housing can be prevented from leaking outside.

If a sealed terminal and a push nut are preassembled as a unit, they can be fitted within a fitting hole with only a single action in which the sealed terminal and the push nut are inserted together, and thus a further reduction of the assembling work can be attained.

While the preferred form of the present invention has been described, variations thereto will occur to those skilled in the art within the scope of the present inventive concepts, which are delineated by the following claims.

What is claimed is:

1. A scroll compressor comprising:

a hermetic housing having an outer wall;

a stationary scroll and a swivel scroll provided within said hermetic housing and engaged with each other such that said swivel scroll can undergo revolutional swivel motions;

a fitting hole that passes through said outer wall of said hermetic housing, said fitting hole having an inner diameter;

a sealed terminal provided in said fitting hole; and a push nut pressed into said fitting hole so as to hold said sealed terminal in said fitting hole, said push nut comprising a plurality of nails thereon having an outer diameter that is slightly larger than said inner diameter of said fitting hole.

2. The scroll compressor of claim 1, wherein said push nut comprises a circumferential member having said plurality of nails thereon at equal intervals.

3. The scroll compressor of claim 2, wherein said circumferential member comprises a center and a hole at said center.

4. The scroll compressor of claim 3, wherein a cover tube having a signal wire therein extends through said hole.

5. The scroll compressor of claim 2, wherein said sealed terminal and said push nut are directly fixed with each other so as to form a pre-assembled unit.

6. The scroll compressor of claim 5, wherein said push nut is mounted on a rear surface of said sealed terminal by spot welding.

7. The scroll compressor of claim 5, wherein said sealed terminal comprises a front part and a rear part, and wherein said push nut is disposed between said front and rear parts.

8. The scroll compressor of claim 1, wherein said push nut comprises a center and a hole at said center.

9. The scroll compressor of claim 8, wherein a cover tube having a signal wire therein extends through said hole.

10. The scroll compressor of claim 8, wherein said sealed terminal and said push nut are directly fixed with each other so as to form a pre-assembled unit.

11. The scroll compressor of claim 10, wherein said push nut is mounted on a rear surface of said sealed terminal by spot welding.

12. The scroll compressor of claim 10, wherein said sealed terminal comprises a front part and a rear part, and wherein said push nut is disposed between said front and rear parts.

13. The scroll compressor of claim 1, wherein said sealed terminal and said push nut are directly fixed with each other so as to form a pre-assembled unit.

14. The scroll compressor of claim 13, wherein said push nut is mounted on a rear surface of said sealed terminal by spot welding.

15. The scroll compressor of claim 13, wherein said sealed terminal comprises a front part and a rear part, and wherein said push nut is disposed between said front and rear parts.

16. The scroll compressor of claim 1, wherein said push nut comprises a central member, said plurality of nails extending radially from said central member, and wherein said plurality of nails extend to said diameter slightly larger than said inner diameter of said fitting hole in an uncompressed state, said plurality of nails being compressed by said fitting hole such that said nails tend to bite into and engage a surface of said outer wall.

17. The scroll compressor of claim 16, wherein said nails extend at an angle from said central member in a direction away from said sealed terminal.

* * * * *